US005972549A

United States Patent [19]

Levin et al.

[11] Patent Number: 5,972,549

[45] Date of Patent: Oct. 26, 1999

[54] DUAL LAYER PHOTOCONDUCTORS WITH CHARGE GENERATION LAYER CONTAINING HINDERED HYDROXYLATED AROMATIC COMPOUND

[75] Inventors: Ronald Harold Levin; Scott Thomas Mosier, both of Boulder, Colo.

[73] Assignee: Lexmark International, Inc., Lexington, Ky.

[21] Appl. No.: 09/023,753

[22] Filed: Feb. 13, 1998

[51] Int. Cl.[6] ..... G03G 5/047

[52] U.S. Cl. ..... 430/59; 430/76

[58] Field of Search ..... 430/58, 59, 76

[56] References Cited

U.S. PATENT DOCUMENTS

| | | | |
|---|---|---|---|
| 4,150,987 | 4/1979 | Anderson et al. | 96/1.5 |
| 4,362,798 | 12/1982 | Anderson et al. | 430/59 |
| 4,522,906 | 6/1985 | Asao et al. | 430/60 |
| 4,563,408 | 1/1986 | Lin et al. | 430/59 |
| 4,873,164 | 10/1989 | Ono et al. | 430/58 |
| 4,888,262 | 12/1989 | Tamaki et al. | 430/58 |
| 5,059,503 | 10/1991 | Muto et al. | 430/83 |
| 5,096,793 | 3/1992 | Osawa et al. | 430/58 |
| 5,130,215 | 7/1992 | Adley et al. | 430/58 |
| 5,162,181 | 11/1992 | Fujimoto et al. | 430/58 |
| 5,192,633 | 3/1993 | Iwasaki et al. | 430/59 |
| 5,292,603 | 3/1994 | Sakai et al. | 430/18 |
| 5,308,727 | 5/1994 | Osawa et al. | 430/58 |
| 5,324,610 | 6/1994 | Tanaka et al. | 430/83 |
| 5,340,675 | 8/1994 | Monbaliu et al. | 430/58 |
| 5,344,733 | 9/1994 | Suzuki et al. | 430/58 |
| 5,378,568 | 1/1995 | Okaji et al. | 430/58 |
| 5,399,453 | 3/1995 | Dohi et al. | 430/59 |
| 5,443,933 | 8/1995 | Fujimori et al. | 430/59 |
| 5,456,989 | 10/1995 | Nogami et al. | 430/59 |
| 5,474,868 | 12/1995 | Adachi et al. | 430/58 |
| 5,494,766 | 2/1996 | Dohi et al. | 430/59 |
| 5,514,508 | 5/1996 | Fukami et al. | 430/76 |
| 5,521,044 | 5/1996 | Muto et al. | 430/83 |
| 5,529,868 | 6/1996 | Machimo et al. | 430/59 |
| 5,545,499 | 8/1996 | Balthis et al. | 430/59 |
| 5,547,790 | 8/1996 | Umeda et al. | 430/58 |
| 5,567,557 | 10/1996 | Mori | 430/58 |
| 5,578,405 | 11/1996 | Ikegami et al. | 430/59 |
| 5,595,845 | 1/1997 | Maeda et al. | 430/58 |
| 5,595,846 | 1/1997 | Shigematsu et al. | 430/58 |
| 5,670,284 | 9/1997 | Kishi et al. | 430/58 |

*Primary Examiner*—John Goodrow

*Attorney, Agent, or Firm*—Holly D. Kozlowski; John A. Brady; Jacqueline M. Daspit

[57] ABSTRACT

Photoconductors comprise a substrate, a charge transport layer, and a charge generation layer. The charge transport layer comprises binder and a charge transport compound comprising at least one of a hydrazone, aromatic amine, or substituted aromatic amine, and the charge generation layer comprises binder, a phthalocyanine charge generating compound and a hindered hydroxylated aromatic compound. The hindered hydroxylated aromatic compound reduces electrical fatigue upon cycling without adversely effecting the electrical performance of the photoconductors.

24 Claims, 1 Drawing Sheet

DUAL LAYER PHOTOCONDUCTORS WITH CHARGE GENERATION LAYER CONTAINING HINDERED HYDROXYLATED AROMATIC COMPOUND

FIELD OF THE INVENTION

The present invention is directed to dual layer photoconductors which comprise a charge transport layer and a charge generation layer formed on a substrate. More particularly, the invention is directed to such dual layer photoconductors wherein the charge generation layer includes a hindered hydroxylated aromatic compound which can provide the photoconductor with improved resistance to cycling fatigue.

BACKGROUND OF THE INVENTION

In electrophotography, a latent image is created on the surface of an imaging member such as a photoconducting material by first uniformly charging the surface and then selectively exposing areas of the surface to light. A difference in electrostatic charge density is created between those areas on the surface which are exposed to light and those areas on the surface which are not exposed to light. The latent electrostatic image is developed into a visible image by electrostatic toners. The toners are selectively attracted to either the exposed or unexposed portions of the photoconductor surface, depending on the relative electrostatic charges on the photoconductor surface, the development electrode and the toner.

Typically, a dual layer electrophotographic photoconductor comprises a substrate such as a metal ground plane member on which a charge generation layer (CGL) and a charge transport layer (CTL) are coated. The charge transport layer contains a charge transport material which comprises a hole transport material or an electron transport material. For simplicity, the following discussions herein are directed to use of a charge transport layer which comprises a hole transport material as the charge transport compound. One skilled in the art will appreciate that if the charge transport layer contains an electron transport material rather than a hole transport material, the charge placed on a photoconductor surface will be opposite that described herein.

Generally, when the charge transport layer containing a hole transport material is formed on the charge generation layer, a negative charge is typically placed on the photoconductor surface. Conversely, when the charge generation layer is formed on the charge transport layer, a positive charge is typically placed on the photoconductor surface. Conventionally, the charge generation layer comprises a polymeric binder containing a charge generating compound or molecule while the charge transport layer comprises a polymeric binder containing the charge transport compound or molecule. The charge generating compounds within the CGL are sensitive to image-forming radiation and photogenerate electron-hole pairs within the CGL as a result of such radiation. The CTL is usually non-absorbent of the image-forming radiation and the charge transport compounds serve to transport holes to the surface of a negatively charged photoconductor. Photoconductors of this type are disclosed in the Adley et al U.S. Pat. No. 5,130,215 and the Balthis et al U.S. Pat. No. 5,545,499.

Generally, various materials which are included in the photoconductor are sensitive to oxidative degradation. Typically, antioxidants are incorporated into the charge transport layer in order to improve the resistance of the photoconductor to oxidative degradation. For example, the Iwasaki et al U.S. Pat. No. 5,192,633, the Shigematsu et al U.S. Pat. No. 5,595,846 and the Kishi et al U.S. Pat. No. 5,670,284 all disclose the use of antioxidants in a charge transfer layer of a dual layer photoconductor in order to improve the oxidative degradation resistance of the photoconductor.

Unfortunately, many commonly employed antioxidants have been determined to significantly increase photoconductor fatigue, both initially and upon cycling, when incorporated into the charge transport layer. Generally, increased fatigue is evidenced by increases in the discharge voltage of the photoconductor, either initially or upon cycling. Fatigue is undesirable as it can reduce the development vector thereby resulting in light or washed out print as well as print that varies from page to page. Accordingly, there is a continuing need for improved photoconductors which exhibit good resistance to oxidative degradation while maintaining good sensitivity, stability and durability.

SUMMARY OF THE INVENTION

Accordingly, objects of the present invention are to provide charge generation layers having a hindered hydroxylated aromatic compound and to provide photoconductors which exhibit improved properties and/or performance. More particularly, it is an object of the present invention to provide dual layer photoconductors which exhibit improved resistance to oxidative degradation while maintaining good electrical performance and durability. It is a further object to provide such photoconductors without increasing the fatigue exhibited by the photoconductor.

These and additional objects and advantages are provided by the dual layer photoconductors according to the present invention in which the charge generation layer includes a hindered hydroxylated aromatic compound. Generally, the photoconductors according to the present invention comprise a substrate, a charge transport layer and a charge generation layer, wherein the charge transport layer comprises binder and a charge transport compound and the charge generation layer comprises binder, a charge generating compound and a hindered hydroxylated aromatic compound.

The dual layer photoconductors according to the present invention are advantageous in that they exhibit good electrical performance, including good sensitivity and/or good residual voltage, and resistance to oxidative degradation. The photoconductors according to the present invention are also advantageous in that they do not exhibit increased fatigue as compared with conventional photoconductors wherein the charge generation layer does not contain the hindered hydroxylated aromatic compound. Further, the present photoconductors do not suffer from an increase in initial residual potential as often occurs with photoconductors in which an antioxidant is incorporated into the charge transport layer.

These and additional objects and advantages will be further apparent in view of the following detailed description.

BRIEF DESCRIPTION OF THE DRAWING

The present invention as set forth in the detailed description will be more fully understood when viewed in connection with the drawing in which.

DETAILED DESCRIPTION

Figure 1:
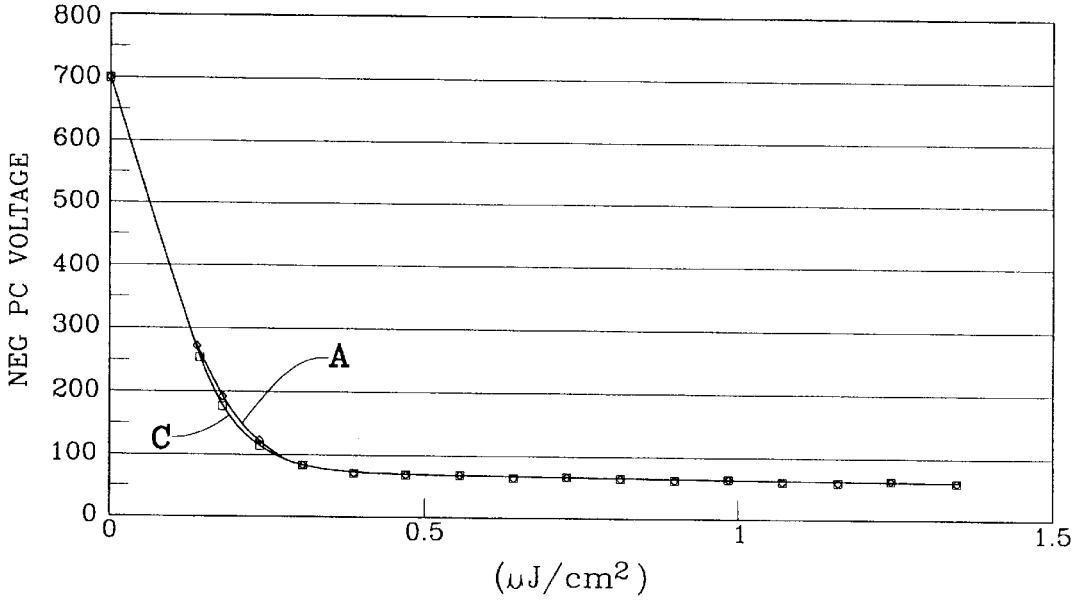
FIG. 1 sets forth the electrical performance of a photoconductor according to the present invention wherein the charge generation layer includes a hindered hydroxylated aromatic compound and the electrical performance of a conventional photoconductor which is free of the hindered hydroxylated aromatic compound.

The dual layer photoconductors according to the present invention comprise a substrate, a charge transport layer and a charge generation layer, wherein the charge transport layer comprises binder and a charge transport compound and the charge generation layer comprises binder, a charge generating compound and a hindered hydroxylated aromatic compound. Preferably, the hindered hydroxylated aromatic compound acts as an antioxidant in the photoconductor.

The photoconductor substrate may be flexible, for example in the form of a flexible web or a belt, or inflexible, for example in the form of a drum. Typically, the photoconductor substrate is uniformly coated with a thin layer of a metal, preferably aluminum, which functions as an electrical ground plane. In a further preferred embodiment, the aluminum is anodized to convert the aluminum surface into a thicker aluminum oxide surface. Alternatively, the ground plane member may comprise a metallic plate, such as aluminum or nickel, a metallic drum or foil, or a plastic film on which aluminum, tin oxide or indium oxide or the like is vacuum evaporated.

The charge generation layer may be formed on the photoconductor substrate, followed by formation of the charge transport layer, whereby the photoconductor is then typically subjected to negative charging, or, conversely, the charge transport layer may be formed on the photoconductor substrate and the charge generation layer is in turn formed on the charge transport layer, whereby the photoconductor surface is then typically subjected to positive charging.

The charge transport layer included in the dual layer photoconductors according to the present invention comprises binder and a charge transport compound. The charge transport layer is in accordance with conventional practices in the art and therefore may include binder and a charge transport compound generally known in the art for use in charge transport layers. Typically, the binder is polymeric and may comprise, but is not limited to, vinyl polymers such as polyvinyl chloride, polyvinyl butyral, polyvinyl acetate, styrene polymers, and copolymers of these vinyl polymers, acrylic acid and acrylate polymers and copolymers, polycarbonate polymers and copolymers, including polyestercarbonates, polyesters, alkyd resins, polyamides, polyurethanes, epoxy resins and the like. Preferably, the polymeric binder of the charge transport layer is inactive, i.e., it does not exhibit charge transporting properties.

Charge transport compounds suitable for use in the charge transport layer of the photoconductors of the present invention should be capable of supporting the injection of photogenerated holes or electrons from the charge generation layer (depending upon the charging polarity) and allowing the transport of these holes or electrons through the charge transport layer to selectively discharge the surface charge. Preferable charge transport compounds for use in the charge transport layer of negatively charged photoconductors comprise aromatic amines (including aromatic diamines), substituted aromatic amines (including substituted aromatic diamines), or hydrazone compounds, examples of which include, but are not limited to, those discussed herein.

Suitable aromatic amine transport compounds, including aromatic diamine transport compounds, and substituted aromatic amines and substituted aromatic diamine transport compounds, are of the types described in U.S. Pat. Nos. 4,306,008, 4,304,829, 4,233,384, 4,115,116, 4,299,897, 4,265,990 and/or 4,081,274. Typical diamine transport compounds include N,N'-diphenyl-N,N'-bis(alkylphenyl)-[1,1'-biphenyl]-4,4'-diamines wherein the alkyl is, for example, methyl, ethyl, propyl, n-butyl, or the like, or halogen substituted derivatives thereof, and the like.

Preferred hydrazone transport molecules include derivatives of aminobenzaldehydes, cinnamic esters or hydroxylated benzaldehydes. Exemplary amino benzaldehyde-derived hydrazones include those set forth in the Anderson et al U.S. Pat. Nos. 4,150,987 and 4,362,798, while exemplary cinnamic ester-derived hydrazones and hydroxylated benzaldehyde-derived hydrazones are set forth in the copending Levin et al U.S. applications Ser. Nos. 08/988,600 and 08/988,791, respectively, all of which patents and applications are incorporated herein by reference. Additional hydrazone transport molecules include p-diethylaminobenzaldehyde-(diphenylhydrazone), p-diphenylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example, in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example, in U.S. Pat. Nos. 4,385,106, 4,338,388, 4,387,147, 4,399,208 and 4,399,207. Yet other hydrazone charge transport molecules include carbazole phenyl hydrazones such a 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426. Preferably, the charge transport compound included in the charge transport layer comprises a hydrazone, an aromatic amine (including aromatic diamines), a substituted aromatic amine (including substituted aromatic diamines), or a mixture thereof.

The charge transport layer typically comprises the charge transport compound in an amount of from about 5 to about 60 weight percent, based on the weight of the charge transport layer, and more preferably in an amount of from about 20 to about 50 weight percent, based on the weight of the charge transport layer, with the remainder of the charge transport layer comprising the binder, and any conventional additives.

As set forth above, the charge generation layer comprises binder, a charge generating compound and a hindered hydroxylated aromatic compound. The polymeric binder of the charge generation layer may be any polymeric binder known in the art for use in charge generation layers. Preferably, the binder of the charge generation layer is inactive, i.e, it does not exhibit either charge generation or charge transporting properties, and may comprise any of the binders noted above for use in the charge transport layer. Preferably, the charge generation layer comprises the binder in an amount of from about 10 to about 90 weight percent and more preferably in an amount of from about 20 to about 75 weight percent, based on the weight of the charge generation layer.

Various charge generation compounds which are known in the art are suitable for use in the charge generation layer of the photoconductors according to the present invention. Phthalocyanine dyes, including both metal-free forms such as X-form metal-free phthalocyanines and the metal-containing phthalocyanines, such as disclosed in U.S. Pat. Nos. 4,664,997, 4,725,519 and 4,777,251, are preferred charge generating compounds for use in the present photoconductors. Particularly preferred charge generating compounds for use in the charge generation layer according to the present invention comprise metal-containing phthalocyanines, and, more particularly, metal-containing phthalocyanines wherein the metal is a transition metal or a group IIIA metal. Of these metal-containing phthalocyanine charge generating compounds, those containing a transition metal such as copper, titanium or manganese or containing aluminum as a group IIIA metal are preferred. It is further preferred that the metal-containing phthalocyanine charge generating compound is oxy, thio or dihalo substituted. Oxo-titanyl phthalocyanines are especially preferred.

The charge generating compounds are employed in the charge generation layer in conventional amounts suitable for providing the charge generation effects. Suitably, the charge generation layer comprises at least about 5 weight percent, based on the weight of the charge generation layer, of the charge generating compound, and preferably at least about 10 weight percent, up to about 60 weight percent, based on the weight of the charge generation layer. In further preferred embodiments, the charge generation layer comprises at least about 15 weight percent of the charge generating compound and preferably from about 20 to about 50 weight percent of the charge generating compound, based on the weight of the charge generation layer.

In accordance with an important feature of the present invention, the charge generation layer further comprises a hindered hydroxylated aromatic compound. The hindered hydroxylated compound provides the photoconductor with resistance to oxidative degradation as compared with a photoconductor which does not include an antioxidant component. Additionally, the hindered hydroxylated aromatic compound, when incorporated specifically into the charge generation layer, provides the antioxidant effect without causing the photoconductor to exhibit increased fatigue as compared with a photoconductor which does not include an antioxidant in either the charge generation layer or the charge transport layer. Further, by including the hindered hydroxylated aromatic compound in the charge generation layer, rather than the charge transport layer, the significant increases in fatigue which were observed when an antioxidant was incorporated into the charge transport layer of a photoconductor are avoided. Thus, in a preferred embodiment of the present invention, the charge transport layer is free of antioxidant (in the sense that no antioxidant is intentionally added thereto) and particularly is free of a hindered hydroxylated aromatic antioxidant.

The hindered hydroxylated aromatic compound employed in the present invention has at least one hydroxy substituent and at least one hydrocarbon substituent. The hindered hydroxylated aromatic compound is typically a monocyclic or polycyclic aromatic compound containing at least one substituent which comprises an alkyl, aryl, alkaryl, arylalkyl, alkoxy or ester-containing group, and at least one substituent which comprises a hydroxy group.

Suitable compounds include:

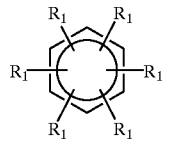

or

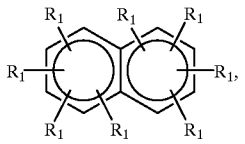

wherein each $R_1$ independently comprises hydrogen, hydroxy, alkyl, aryl, alkyaryl, arylalkyl, alkoxy or ester-containing group, provided that at least one $R_1$ is not hydrogen or hydroxy and at least one $R_1$ is a hydroxy group. In a preferred embodiment, the compound is monocyclic and the hindered hydroxylated aromatic compound comprises a hindered phenolic compound. Additionally, when the hindered hydroxylated aromatic compound contains more than one aromatic group, each aromatic group preferably comprises at least one hydroxy group. In these embodiments, it is preferred that at least one $R_1$ substituent which is not hydrogen or hydroxy is arranged in the para position with respect to the hydroxyl group. In another preferred embodiment, wherein the hindered hydroxylated aromatic compound is a hindered phenolic compound, the non-hydrogen, non-hydroxy $R_1$ substituent or substituents are positioned ortho and/or para to the hydroxyl group. In another preferred embodiment wherein the hindered hydroxylated aromatic compound is a hindered phenolic compound, three of the $R_1$ groups are not hydrogen or hydroxy and are para, ortho and ortho, respectively, with respect to the hydroxyl group. Suitably, the non-hydrogen, non-hydroxy $R_1$ substituent or substituents contain from about 1 to about 40 carbon atoms and more preferably from about 1 to about 24 carbon atoms. In order that the phenolic compound is sufficiently hindered, it is preferred that both of the $R_1$ groups ortho to the hydroxy group contain from about 4 to about 24 carbon atoms.

Examples of $R_1$ groups particularly suitable for use in the hindered hydoxylated aromatic compounds of the present invention include, but are not limited to, straight and branched chain alkyl groups of from 1 to about 12 carbon atoms, with branched groups such as tert-butyl groups being preferred, aryl-substituted alkyl groups wherein the aryl group(s) may in turn be substituted, and ester groups such as those of the formula $—(CH_2)_x—COO—C_yH_{2y+1}$ wherein x is an integer of from about 1 to about 12 and y is an integer of from about 1 to about 24.

The charge generation layer comprises the hindered hydroxylated aromatic compound in an amount sufficient to provide the photoconductor with improved resistance to oxidative degradation. Suitably, the charge generation layer comprises from about 0.1 to about 10 weight percent, by weight of the charge generation layer, of the hindered hydroxylated aromatic compound. More preferably, the charge generation layer comprises from about 0.5 to about 5 weight percent, by weight of the charge generation layer, of the hindered hydroxylated aromatic compound.

The photoconductor imaging members described herein may be prepared according to conventional techniques. Typically, the photoconductor substrate will have a thickness adequate to provide the required mechanical stability, the charge generation layer will have a thickness of from about 0.05 to about 5.0 microns, and the charge transport layer will have a thickness of from about 10 to about 50 microns. In accordance with techniques known in the art, a barrier layer may be provided between the ground plane and the charge generation layer, typically having a thickness of from about 0.05 to about 25 microns. The charge generation layer may be formed by dispersing or dissolving the charge generating compound and hindered hydroxylated aromatic compound in a polymeric binder and solvent, coating the dispersion or solution on the respective underlying layer and drying the coating. Similarly, the charge transport layer may be formed by dispersing or dissolving the charge transport compound in a polymeric binder and solvent, coating the dispersion or solution on the respective underlying layer and drying the coating.

Various embodiments of the photoconductors according to the present invention are illustrated in the following examples. In the examples and throughout the present specification, parts and percentages are by weight unless otherwise specified.

EXAMPLE 1

In this example, a photoconductor according to the present invention and two comparative photoconductors were prepared. In each photoconductor, a charge generation layer was formed on an aluminum substrate and a charge transport layer was formed on the charge generation layer. The charge transport layer of each photoconductor comprised about 40 weight percent of a charge transport compound comprising N,N'-bis-(3-methylphenyl)-N,N'-bis-phenyl-benzidine (TPD) of the formula:

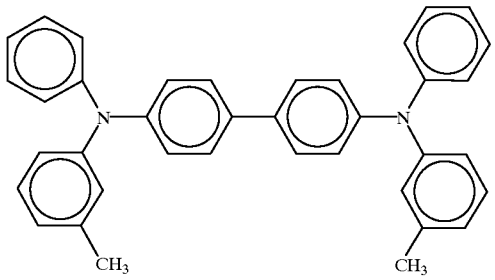

and a balance of a polymer binder. The charge generation layer of each photoconductor comprised about 45 weight percent oxo-titanyl phthalocyanine pigment and a balance of polymer binder. The first comparative photoconductor, photoconductor A, did not contain any antioxidant. The second comparative photoconductor, photoconductor B, contained 3.5 weight percent of a hindered hydroxylated aromatic antioxidant in the charge transport layer. The antioxidant comprised octadecyl 3-(3,5-di-tert-butyl-4-hydroxyphenyl) propionate of the formula:

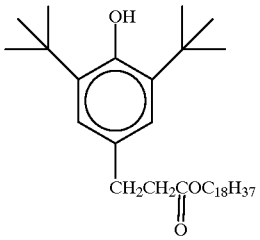

The photoconductor according to the invention, photoconductor C, contained 3.5 weight percent of the same hindered hydroxylated aromatic antioxidant in the charge generation layer.

The photoconductors of this example were subjected to measurement of cycling fatigue by measurement of the change in charge voltage $V_{charge}$ and discharge voltage $V_{discharge}$ over a number of imaging cycles. The results of these measurements are set forth in Table 1, wherein the change in the difference between the charge and discharge voltages, $(V_{charge}—V_{discharge})_{initial}—(V_{charge}—V_{discharge})_{final}$, is indicated as Vector Fatigue.

TABLE 1

Cycling Fatigue Results

| Photo-conductor | Description | 0 K (initial) | 2.2 K | Vector Fatigue |
|---|---|---|---|---|
| A | no AO | −651/−56 | −641/−69 | −23 |
| B | 3.5% AO in CTL | −692/−80 | −699/−145 | −58 |
| C | 3.5% AO in CGL | −683/−90 | −660/−72 | −5 |

The results in Table 1 demonstrate that the cycling fatigue of photoconductor C according to the present invention was not significant, whereby the photoconductor exhibited good consistent performance. In contrast, photoconductor B, in which the antioxidant was in the charge transport layer exhibited significant cycling fatigue. It is also surprising that photoconductor C according to the invention exhibited decreased fatigue as compared with photoconductor A which did not contain any of the antioxidant compound.

Photoconductors A and C of this example were also subjected to sensitivity measurements using a sensitometer fitted with electrostatic probes to measure the voltage magnitude of the photoconductor's latent electrostatic image. The sensitometer included a charging source designed to charge the photoconductor to about −700 V. The photosensitivity was determined by varying the amount of light incident on the photoconductor surface, in micro joules/$cm^2$, and measuring the resultant voltage remaining on the photoconductor surface. The results of these measurements are set forth in FIG. 1. Photoconductor C (curve C in FIG. 1) according to the invention exhibited sensitivity and residual voltage properties comparable to those of photoconductor A (curve A in FIG. 1) containing none of the antioxidant, which indicates that the advantage provided by the antioxidant in increased resistance to fatigue can be obtained without sacrificing electrical performance.

EXAMPLE 2

In this example, two sets of photoconductors, D, E and F, G, were prepared. These sets of photoconductors were each similar to the photoconductors of Example 1 except that in photoconductors D and E the charge transport compound comprised 4-N,N-diethylaminobenzaldehyde-N',N'-diphenylhydrazone (DEH) of the formula:

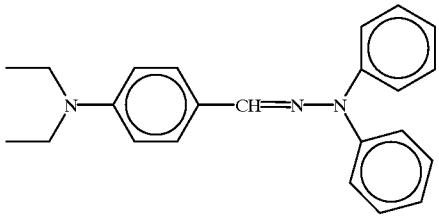

and the CGL comprised bis(4-(dimethylamino)phenyl) squaraine as the charge generating compound. In photoconductors F and G, the charge transport compound comprised 4-N,N-diphenylaminobenzaldehyde-N',N'-diphenylhydrazone (TPH) of the formula:

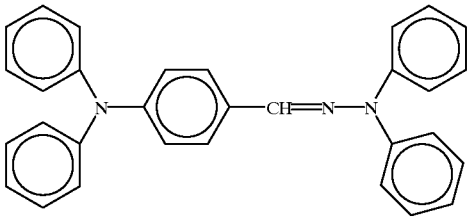

and the same oxo-titanyl phthalocyanine-containing CGL as used in Example 1 was employed.

Photoconductors D and F were free of antioxidant while photoconductors E and G contained antioxidant in the CTL. The photoconductors were subjected to initial and cycling fatigue measurements. Photoconductors E and G which contained the hindered hydroxylated aromatic compound in the charge transport layer exhibited significantly increased fatigue, both initially and upon cycling, as set forth in Table 2, as compared to the photoconductors D and F which did not contain any antioxidant.

TABLE 2

Cycling Fatigue Results

| Photo-conductor | CTC | Description | 0 K | 2.2 K | 4.4 K |
|---|---|---|---|---|---|
| D | DEH | no AO | −684/−128 | −670/−141 | −627/−177 |
| E | DEH | 3.5 AO in CTL | −704/−170 | −698/−206 | −678/−306 |
| F | TPH | no AO | −677/−65 | −670/−62 | −646/−71 |
| G | TPH | 3.5 AO in CTL | −694/−124 | −704/−205 | −678/−237 |

Thus, the photoconductors according to the invention incorporating antioxidant specifically into the CGL provide significant improvement over conventional photoconductors wherein antioxidant is employed in a charge transport layer or wherein no antioxidant is employed.

The foregoing examples and various preferred embodiments of the present invention set forth herein are provided for illustrative purposes only and are not intended to limit the scope of the invention defined by the claims. Additional embodiments of the present invention and advantages thereof will be apparent to one of ordinary skill in the art and are within the scope of the invention defined by the following claims.

We claim:

1. A photoconductor comprising a substrate, a charge transport layer, and a charge generation layer, wherein the charge transport layer comprises binder and a charge transport compound comprising at least one of a hydrazone, aromatic amine, or substituted aromatic amine, and the charge generation layer comprises binder, a phthalocyanine charge generating compound and a hindered hydroxylated aromatic compound.

2. A photoconductor in accordance with claim 1, wherein at least one of the aromatic amine and the aromatic substituted amine is a diamine, and the phthalocyanine charge generating compound is metal containing or non-metal containing.

3. A photoconductor in accordance with claim 2, wherein the phthalocyanine charge generating compound is metal containing and the metal is a transition metal or a group III A metal.

4. A photoconductor in accordance with claim 3, wherein the transition metal is Cu, Ti or Mn and the group III A metal is Al.

5. A photoconductor in accordance with claim 3, wherein the phthalocyanine charge generating compound is oxy, thio or dihalo substituted.

6. A photoconductor in accordance with claim 5, wherein the phthalocyanine charge generating compound is oxo-titanyl phthalocyanine.

7. A photoconductor in accordance with claim 1, wherein the hindered hydroxylated aromatic compound is a monocyclic or polycyclic aromatic compound containing at least one substituent which comprises an alkyl, aryl, alkaryl, arylalkyl, alkoxy, or ester-containing group, and at least one substituent which comprises a hydroxy group.

8. A photoconductor in accordance with claim 7, wherein the hindered hydroxylated aromatic compound is of the formula

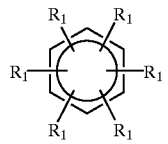

or

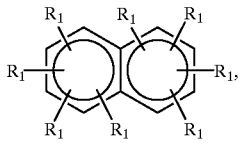

wherein each $R_1$ independently comprises hydrogen, hydroxy, alkyl, aryl, alkaryl, arylalkyl, alkoxy, or ester-containing group, provided that at least one $R_1$ is not hydrogen or hydroxy and at least one $R_1$ is a hydroxy group.

9. A photoconductor in accordance with claim 8, wherein the hindered hydroxylated aromatic compound comprises a hindered phenolic compound.

10. A photoconductor in accordance with claim 8, wherein the hindered hydroxylated aromatic compound comprises one $R_1$ which is hydroxy and comprises one $R_1$ group which is not hydrogen or hydroxy arranged para to the —OH group.

11. A photoconductor in accordance with claim 9, wherein the $R_1$ groups which are in the ortho positions to the —OH group are not hydrogen or hydroxy.

12. A photoconductor in accordance with claim 8, wherein each nonhydrogen $R_1$ group contains from about 1 to about 40 carbon atoms.

13. A photoconductor in accordance with claim 8, wherein at least one $R_1$ group contains from about 4 to about 24 carbon atoms.

14. A photoconductor in accordance with claim 1, wherein the charge generation layer comprises the hindered hydroxylated aromatic compound in an amount sufficient to provide the photoconductor with improved resistance to fatigue.

15. A photoconductor in accordance with claim 1, wherein the charge generation layer comprises from about 0.1 to about 10 weight percent, by weight of the charge generation layer, of the hindered hydroxylated aromatic compound.

16. A photoconductor in accordance with claim 1, wherein the charge generation layer comprises from about 0.5 to about 5 weight percent, by weight of the charge generation layer, of the hindered hydroxylated aromatic compound.

17. A photoconductor in accordance with claim 1, wherein the charge generation layer comprises, by weight of the charge generation layer, from about 5 to about 60 weight percent of the charge generating compound, from about 10 to about 90 weight percent of the binder, and from about 0.1 to about 10 weight percent of the hindered hydroxylated aromatic compound.

18. A photoconductor in accordance with claim 1, wherein the charge generation layer comprises, by weight of the charge generation layer, from about 15 to about 50 weight percent of the charge generating compound, from about 25 to about 75 weight percent to the binder, and from about 0.5 to about 5 weight percent of the hindered hydroxylated aromatic compound.

19. A photoconductor in accordance with claim 1, wherein the charge transport layer comprises from about 5 to about 60 weight percent of the charge transport compound.

20. A photoconductor in accordance with claim 1, wherein the charge transport layer comprises from about 20 to about 50 weight percent of the charge transport compound.

21. A charge generation layer, comprising a hindered hydroxylated aromatic compound.

22. A charge generation layer in accordance with claim 21, wherein the charge generation layer further comprises a binder and a charge generating compound.

23. A charge generation layer in accordance with claim 21, wherein the hindered hydroxylated aromatic compound is a monocyclic or polycyclic aromatic compound containing at least one substituent which comprises an alkyl, aryl, alkaryl, arylalkyl, alkoxy or ester-containing group, and at least one substituent which comprises a hydroxy group.

24. A charge generation layer in accordance with claim 23, wherein the hindered hydroxylated aromatic compound is of the formula:

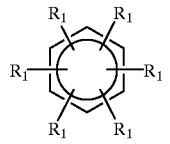

or

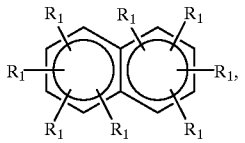

and each $R_1$ independently comprises hydrogen, hydroxy, alkyl, aryl, alkaryl, arylalkyl, alkoxy or ester-containing group, with the proviso that at least one $R_1$ is not hydrogen or hydroxy and at least one $R_1$ is a hydroxy group.

* * * * *